US010202812B2

(12) United States Patent
Gaska

(10) Patent No.: US 10,202,812 B2
(45) Date of Patent: Feb. 12, 2019

(54) MECHANISM FOR RETAINING BITS ON A BLASTHOLE DRILL

(71) Applicant: Harnischfeger Technologies, Inc., Wilmington, DE (US)

(72) Inventor: Jason E. Gaska, Columbus, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 0 days.

(21) Appl. No.: 15/430,072

(22) Filed: Feb. 10, 2017

(65) Prior Publication Data

US 2017/0234086 A1 Aug. 17, 2017

Related U.S. Application Data

(60) Provisional application No. 62/294,658, filed on Feb. 12, 2016.

(51) Int. Cl.

| | |
|---|---|
| ***E21B 15/00*** | (2006.01) |
| ***E21B 19/18*** | (2006.01) |
| ***E21B 7/02*** | (2006.01) |

(52) U.S. Cl.

CPC ..... *E21B 19/18* (2013.01); *E21B 7/02* (2013.01); *E21B 15/00* (2013.01)

(58) Field of Classification Search

CPC ..... E21B 19/18; E21B 7/02; E21B 15/00

See application file for complete search history.

(56) References Cited

U.S. PATENT DOCUMENTS

| | | | | |
|---|---|---|---|---|
| 7,188,547 | B1 * | 3/2007 | West | E21B 19/161 81/57.16 |
| 8,342,236 | B2 | 1/2013 | Bienfang et al. | |
| 2010/0071958 | A1 * | 3/2010 | Bienfang | E21B 19/146 175/85 |
| 2012/0234601 | A1 * | 9/2012 | Griffin | E21B 19/18 175/57 |

* cited by examiner

*Primary Examiner* — D. Andrews
*Assistant Examiner* — Dany E Akakpo
(74) *Attorney, Agent, or Firm* — Michael Best & Friedrich LLP

(57) ABSTRACT

A drill bit retaining assembly includes a ring, a bit clamp member coupled to the ring, and an actuator coupled to the ring. The bit clamp member is movable via the actuator between a first position, in which the bit clamp member is configured to be engaged with a drill bit and a second position in which the bit clamp member is configured to be disengaged from the drill bit.

21 Claims, 13 Drawing Sheets

MECHANISM FOR RETAINING BITS ON A BLASTHOLE DRILL

CROSS-REFERENCE TO RELATED APPLICATIONS

This application claims priority to U.S. Provisional Application No. 62/294,658, filed Feb. 12, 2016, the entire contents of which are incorporated herein by reference.

BACKGROUND OF THE INVENTION

The present invention relates to drill rigs, and more specifically to a mechanism for retaining drill bits on a blasthole drill rig.

Blasthole drill rigs are commonly used in the mining industry to drill through hard rock. Blasthole drill rigs can be found, for example, in coal, copper, and diamond mines throughout the world. A blasthole drill rig typically includes a base, a drill tower extending vertically from the base, and a drill pipe or pipes that are coupled to and supported by the drill tower, and extend into a borehole. Some blasthole drill rigs include a mechanism, such as a carousel, for holding drill bits. Changing the drill bits of blasthole drill rigs has traditionally been performed by an operator and requires manual alignment of the threads of the drill bit with the threads of the pipe string to which it will be mated.

One of the major difficulties in changing drill bits is ensuring that the threads on the drill bit are concentric to the threads in the drill pipe, since tight tolerances are required between the drill pipe and the drill bit when attaching or removing a drill bit from the drill string. Current bit carousels include pots that receive and hold the drill bits not in use. The pots are somewhat oversized to allow the drill bit to easily be inserted. However, the large size of the pots makes it difficult for drill bit changing systems to properly align the drill string and the drill bit. Due to the long length of the drill strings, any misalignment or tilt between the drill bit and the drill string is magnified. Also, some drill rigs include a mast that is stored horizontally, and is then adjustable to an upright vertical position, or to positions between a horizontal and upright vertical position. The drill carousel is coupled to the mast, such that the drill carousel also moves with the mast. A mechanism is therefore desired to hold the drill bits in place in the carousel and prevent the drill bits from falling out of the carousel when the mast is not in the upright, vertical position.

One attempt at solving this problem has been to use three cylinders to extend a drill bit lock through the carousel pot to hold the bit in place (an example is set forth in U.S. Pat. No. 8,342,236). This design is expensive, requiring three sets of hydraulic cylinders, pins, locks, and an accompanying routing. Furthermore, it is unlikely that a multiple cylinder design will hold the bit consistently centered in the pot. For example, if the three cylinders are fed from the same hydraulic line, as one lock engages the drill bit the pressure in the cylinder will increase, forcing flow of hydraulic fluid to the other cylinders. In this instance, the lock will hold the drill bit in the position in which it was placed in the pot, rather than moving the bit to the center of the pot.

SUMMARY

In accordance with one construction, a drill bit retaining assembly includes a ring, a bit clamp member coupled to the ring, and an actuator coupled to the ring. The bit clamp member is movable via the actuator between a first position, in which the bit clamp member is configured to be engaged with a drill bit and a second position in which the bit clamp member is configured to be disengaged from the drill bit.

In accordance with another construction, a drill bit retaining assembly includes a ring having a guide slot, and a side wall having a pin that extends into the guide slot, such that the ring may rotate in a motion prescribed by the pin sliding within the guide slot. The drill bit retaining assembly also includes a bit clamp member coupled to the ring. The bit clamp member includes a first end that is engaged with the ring and a second, opposite end. The second end includes a protrusion that is configured to engage with the drill bit. The drill bit retaining assembly also includes an actuator coupled to the ring. The bit clamp member is movable via the actuator between a first position, in which the bit clamp member is configured to engage with a drill bit and a second position in which the bit clamp member is configured to be disengaged from the drill bit.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways. Also, it is to be understood that the phraseology and terminology used herein is for the purpose of description and should not be regarded as limited.

DETAILED DESCRIPTION

Figure 1:
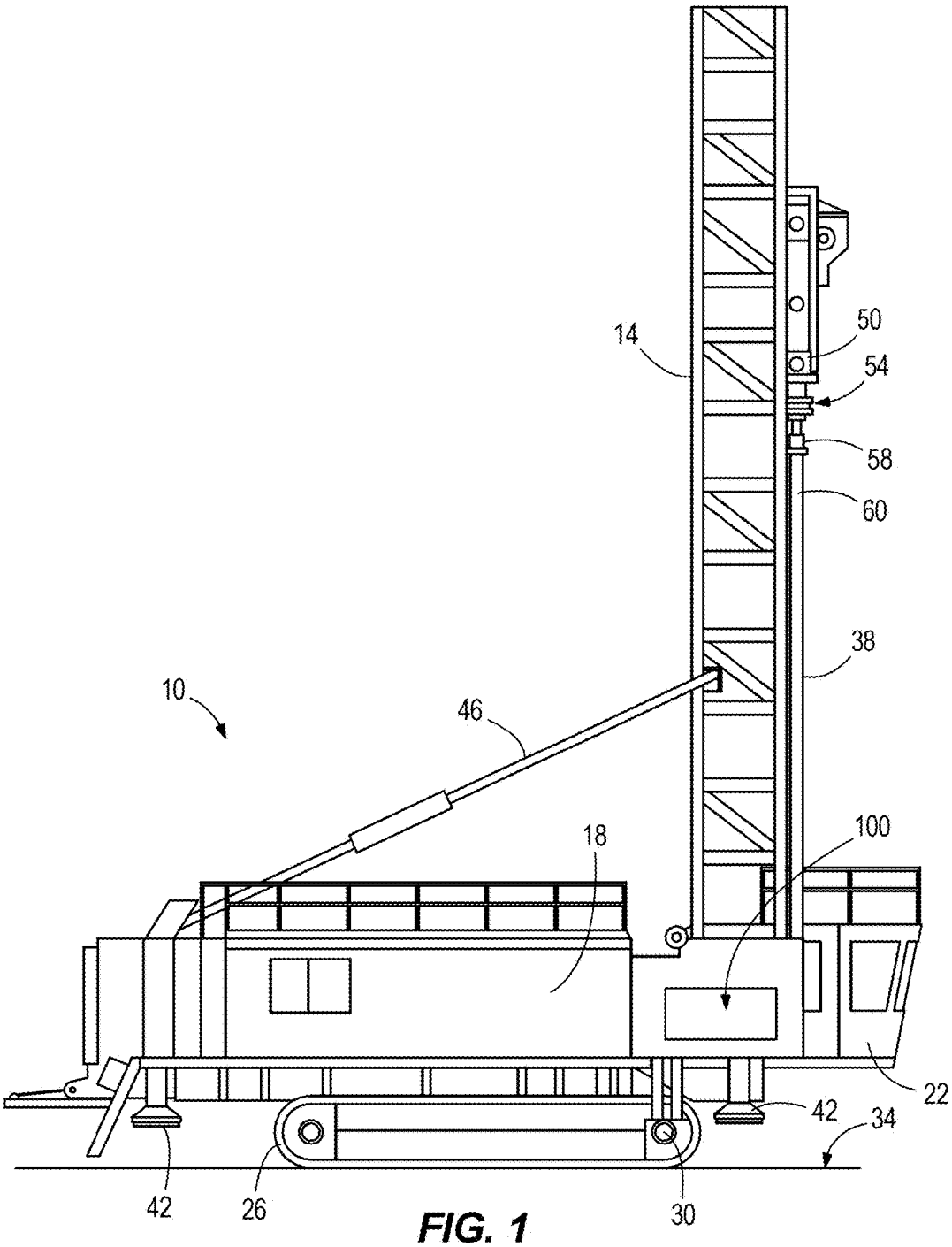
FIG. 1 is a side view of a drill rig according to one construction.

With reference to FIG. 1, in the illustrated construction, a blasthole drill 10 includes a drill tower 14, a base 18 (e.g., a machinery house) beneath the drill tower 14 that supports the drill tower 14, an operator cab 22 coupled to the base 18, and crawlers 26 driven by a crawler drive 30 that drive the blasthole drill 10 along a ground surface 34. The drill tower 14 also includes a drill pipe 38 (e.g., with a drill bit, not shown), which is configured to extend downward (e.g., vertically) through the ground surface 34 and into a borehole. In some constructions, multiple drill pipes 38 are connected together to form an elongated drill string that extends into the borehole.

The blasthole drill 10 also includes leveling jacks 42 to support the blasthole drill 10 on the ground surface 34, a brace 46 that supports the drill tower 14 on the base 18, a drill head motor 50 coupled to the drill tower 14 that drives a drill head 54, and a coupling 58 that couples together the drill head 54 with an upper end 60 of the drill pipe 38. Other constructions of the blasthole drill 10 do not include, for example, the operator cab 22, the brace 46, or one or more other components as described above.

With reference to FIGS. 1-11, the blasthole drill 10 further includes a drill bit changing system 100 (e.g. disposed on the base 18 or on a lower portion of the drill tower 14) for holding one or more drill bits 105 (FIG. 10) and moving the drill bits 105 to a repeatable, centralized location to assist in the exchange of the drill bits 105 to and from the drill pipe(s) 38.

Figure 2:
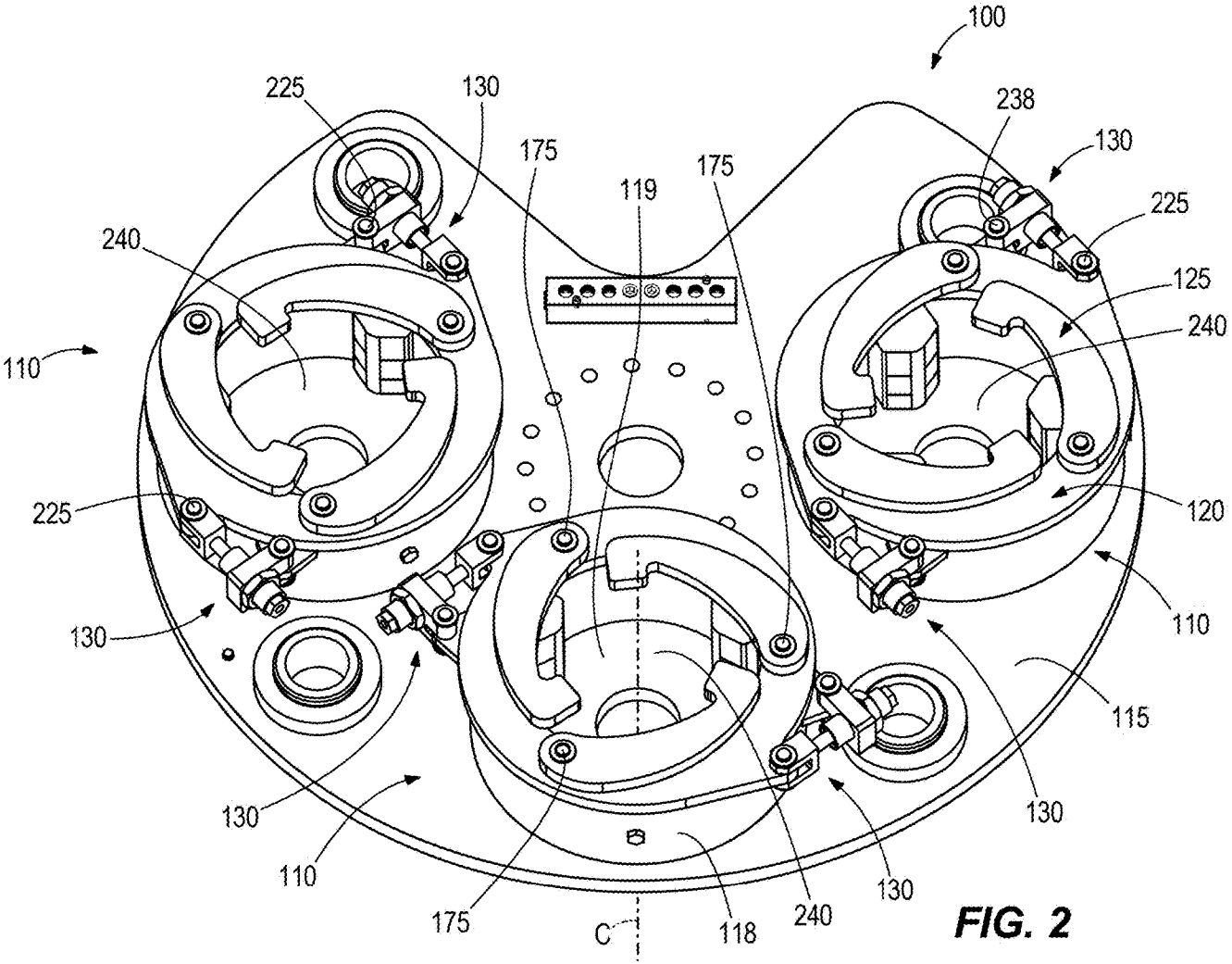
FIG. 2 is a perspective view of a drill bit changing system according to one construction for use on the drill rig of FIG. 1.
Figure 3:
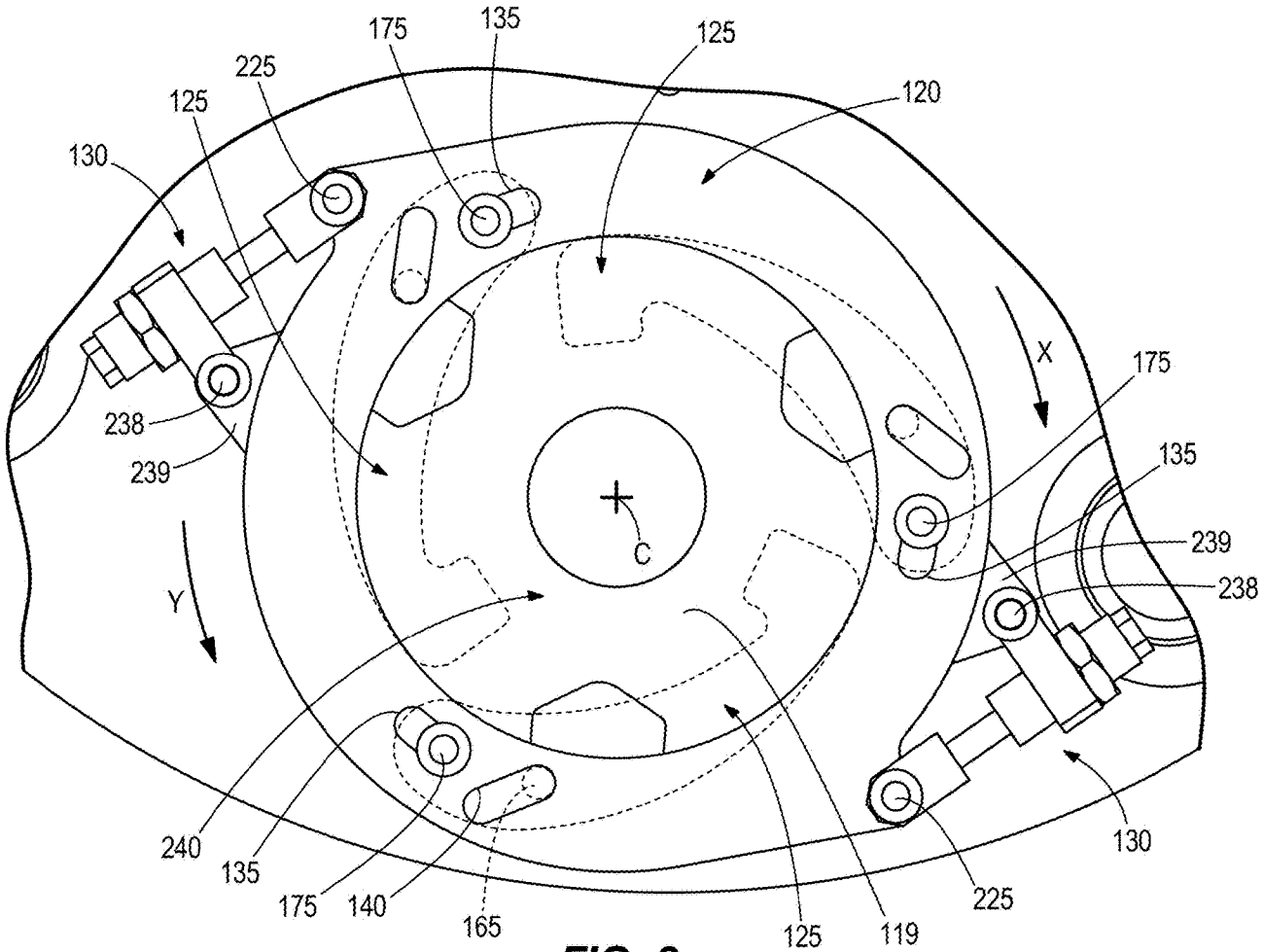
FIG. 3 is an enlarged, top view of a single drill bit retaining assembly of the drill bit changing system of FIG. 2.

With reference to FIGS. 2 and 3, the drill bit changing system 100 includes three drill bit retaining assemblies 110 mounted on a carousel plate 115 of a bit carousel. A raised, circular side wall 118 extends from the carousel plate 115 and defines a carousel pot 119 for receiving a drill bit 105. Each drill bit retaining assembly 110 includes a ring 120, bit clamp members 125, and actuators 130. In the illustrated construction, each drill bit retaining assembly 110 includes two actuators 130. However, in other constructions, one actuator 130, or more than two actuators 130, are used. Each drill bit retaining assembly 110 accommodates a full range of drill bits 105 of different sizes and shapes for use with the blasthole drill 10. Other constructions include different numbers and placement of drill bit retaining assemblies 110, bit clamp members 125, and/or actuators 130 than what is illustrated.

Figure 4:
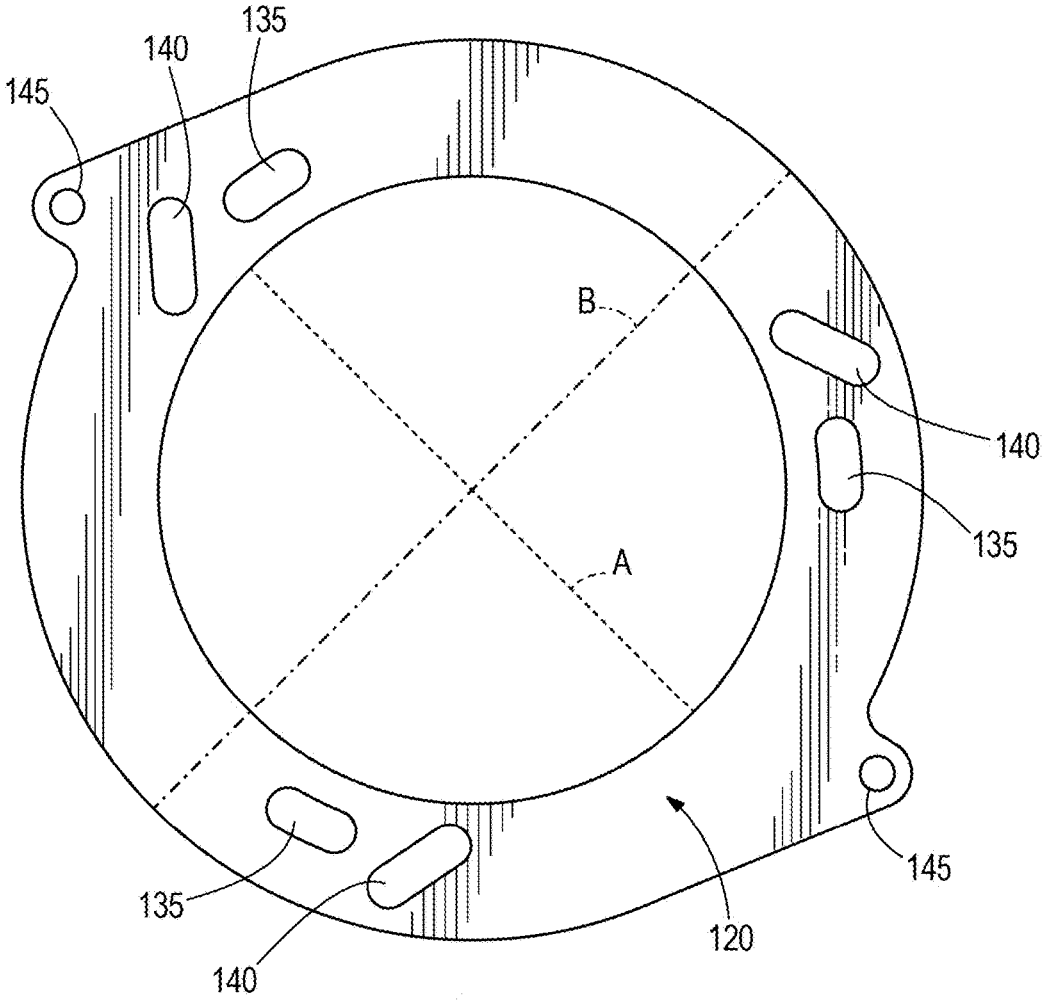
FIG. 4 is a top view of a ring of the drill bit retaining assembly of FIG. 3.

With reference to FIG. 4, each ring 120 includes a guide slot 135 and a dowel positioning slot 140. The guide slot 135 is paired with and positioned proximate the dowel positioning slot 140. In the illustrated construction, three pairs of guide slots 135 and dowel positioning slots 140 are spaced 120 degrees apart from each other around a circumference of the ring 120, although other constructions include different numbers and positions than that illustrated. The ring 120 also includes mounting apertures 145 that engage with the actuators 130. The ring 120 includes an inner diameter A and an outer diameter B. The inner diameter A is sized so that it does not interfere with the drill bit 105 when placed within the drill bit retaining assembly 110. The outer diameter B is sized to provide enough material around the guide slots 135 and dowel positioning slots 140 to prevent cracking of the ring 120. As illustrated in FIG. 2, each ring 120 is positioned above one of the side walls 118.

Figure 5:
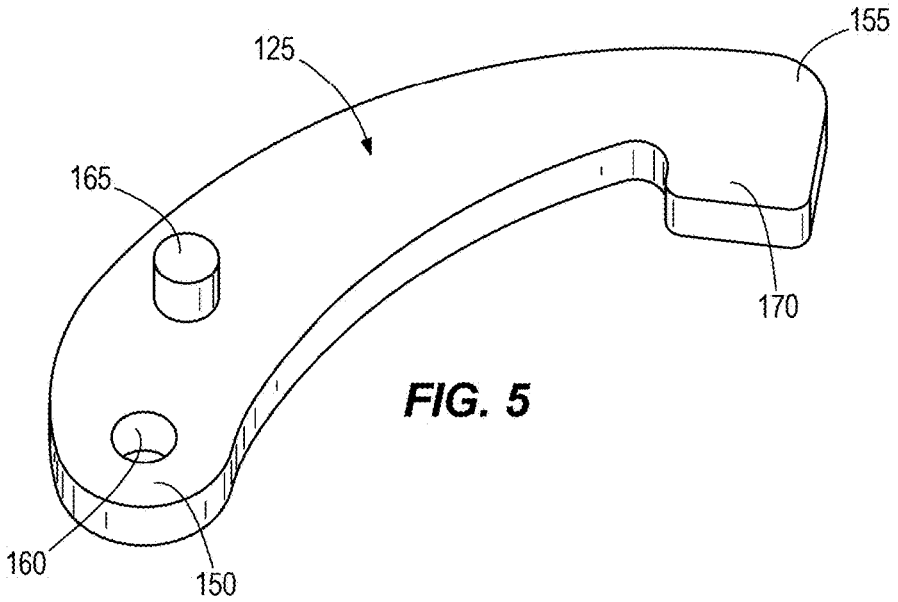
FIG. 5 is a perspective view of a bit clamp member of the drill bit retaining assembly of FIG. 3.

With reference to FIG. 5, in the illustrated construction, each bit clamp member 125 is arcuate and includes a first end 150 and a second end 155 opposite the first end 150. An aperture 160 and a dowel 165 are positioned at the first end 150. A bit engaging protrusion 170 is disposed at the second end 155. In use, the aperture 160 is positioned above the guide slot 135 in the ring 120. The guide slot 135 of the ring 120 forms a track for a pin 175 (FIGS. 2 and 3), which extends up from the side wall 188 and through both the guide slot 135 and the aperture 160. The pin 175 remains stationary, while the ring 120 and bit clamp member 125 both rotate. In some constructions, the pin 175 is integrally formed in one piece with the side wall 188. In some constructions, the pin 175 is a separate component that is assembled to the side wall 188.

Figure 11:
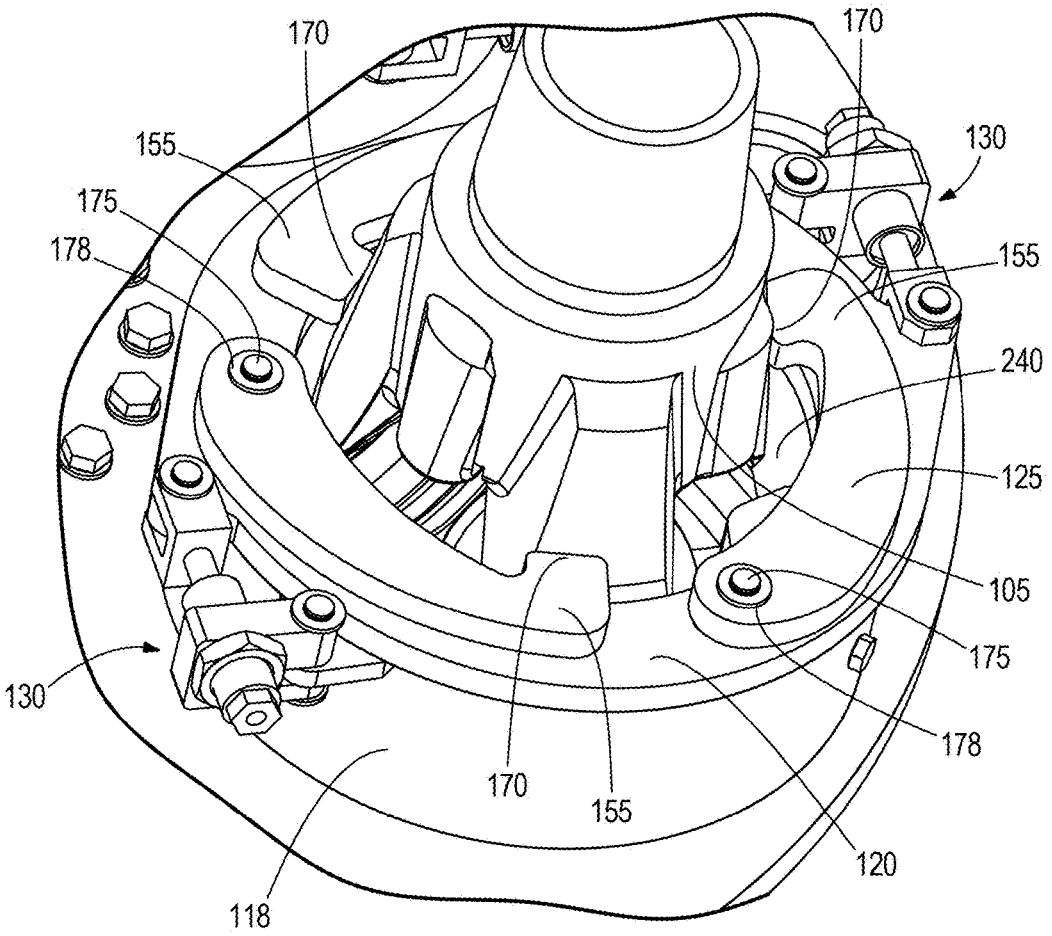
FIG. 11 is a perspective view of the bit positioning assembly of FIG. 3, engaged to the drill bit.

The dowel 165 of the bit clamp member 125 is positioned within the dowel positioning slot 140 in the ring 120 such that the dowel positioning slot 140 forms a track for the dowel 165. The bit clamp member 125 is sized to block debris from accumulating within the guide slot 135 and the dowel positioning slot 140 of the ring 120. In the illustrated construction, the bit clamp members 125 are positioned above the rings 120. In other constructions, the bit clamp members 125 are positioned below the rings 120. In some constructions, more or less than three bit clamp members 125 are provided. With reference to FIG. 11, in the illustrated construction, each ring 120 and bit clamp member 125 is inhibited or prevented from translating (e.g., vertically) relative to the side wall 118 through the use of a retaining member 178. In the illustrated construction, the retaining members 178 are washers that are used with the pins 175, although other constructions include different types of retaining members 178, including snap rings, etc. that allow the rings 120 to rotate, but not to translate relative to the side walls 118.

Figure 6:
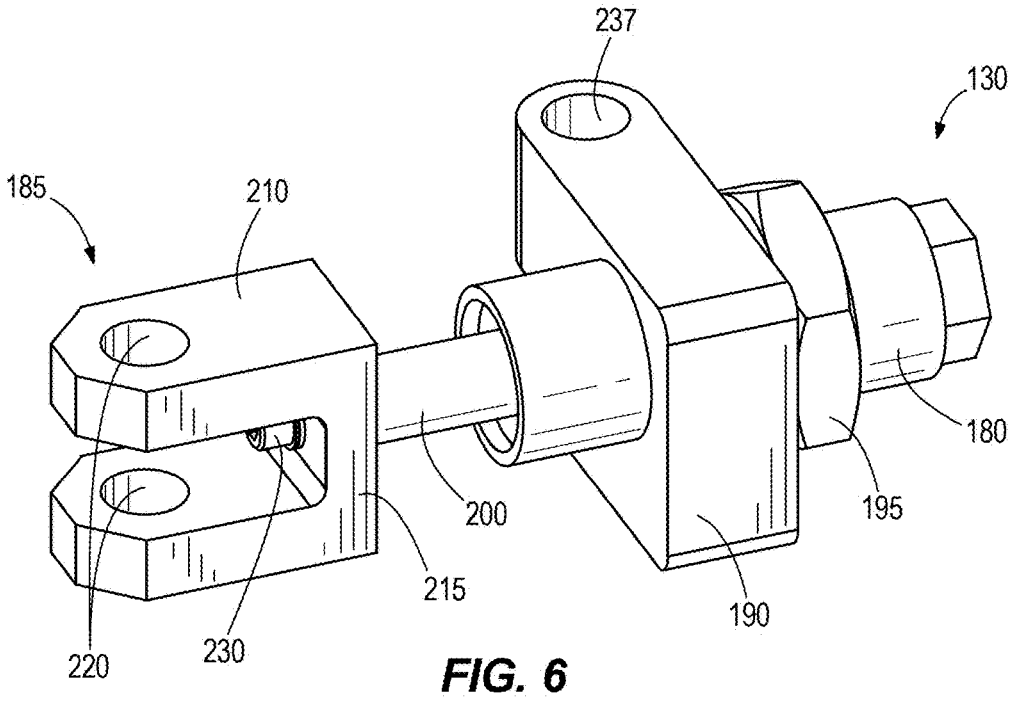
FIG. 6 is a perspective view of an actuator of the drill bit retaining assembly of FIG. 3.
Figure 7:
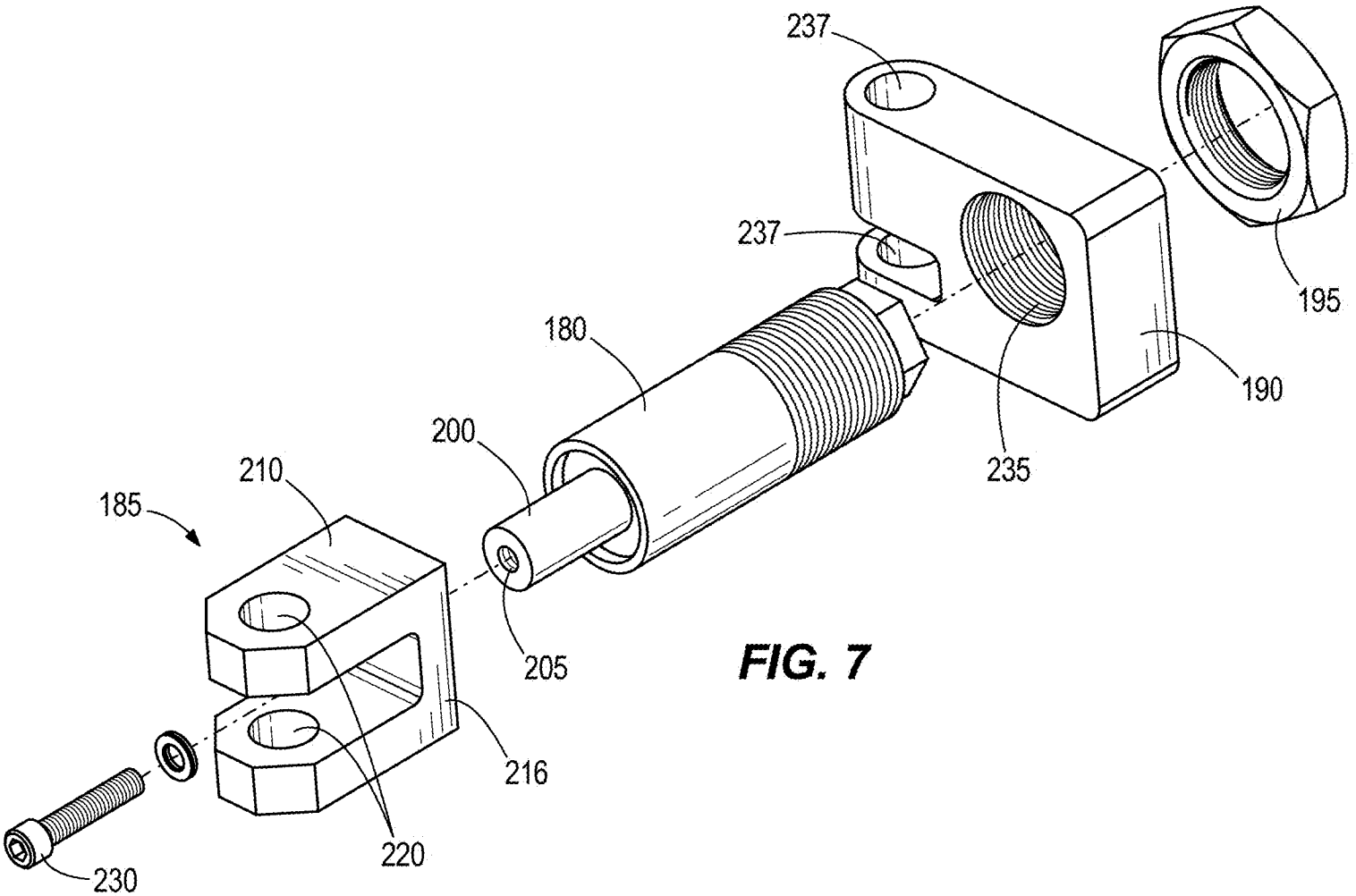
FIG. 7 is an exploded view of the actuator of FIG. 6.

With reference to FIGS. 6 and 7, in the illustrated construction, each actuator 130 includes a hydraulic cylinder 180, a clevis 185, a mounting bracket 190, and a jam nut 195. The cylinder 180 is a single-acting cylinder, having a rod 200 and a spring return. The cylinder 180 is threaded (not shown) on a substantial portion of its external surface. The rod 200 includes a threaded aperture 205 (FIG. 7). The clevis 185 includes arms 210 that are substantially parallel and connected by a connector portion 215. Each arm 210 includes an aperture 220 that is aligned with the mounting aperture 145 on the ring 120 (see FIG. 4), and receives a pin 225 (see FIG. 3). As illustrated in FIGS. 6 and 7, a screw 230 threadedly engages with the threaded aperture 205 in the rod 200.

With continued reference to FIGS. 6 and 7, the mounting bracket 190 also includes a threaded aperture 235 (FIG. 7) and mounting apertures 237. As illustrated in FIG. 3, pins 238 pass through the mounting apertures 237 to attach the actuators 130 to fixed locations on the drill bit changing system 100. In the illustrated construction, each actuator 130 is fixed to a flange 239 extending from the side wall 118 of the drill bit retaining assembly 110, although other constructions include different arrangements.

With continued reference to FIGS. 6 and 7, the cylinder 180 is threadably engaged within the threaded aperture 235 in the mounting bracket 190. The jam nut 195 is threaded and engages with the threads on the external surface of the cylinder 180, fixing the mounting bracket 190 into place along the length of the cylinder 180. The threads along the external surface of the cylinder 180 allow the relative position of the cylinder 180 and the mounting bracket 190 to be adjusted to accommodate differences in machining tolerances or to fit required clamping ranges for drill bits 105 of different sizes, enabling the drill bit changing system 100 to accommodate a full range of drill bits 105 associated with the blasthole drill 10.

In some constructions, the external surface of the cylinder 180 is not threaded and is mounted in any suitable fashion, such as with a pin or a trunion mount. In some constructions, the cylinder 180 is pivotally coupled to the drill bit clamp member 125 rather than the ring 120. In some constructions, the actuator 130 is not limited to using a hydraulic cylinder 180 to actuate the ring 120. For example, in some constructions, the actuator 130 includes pneumatic cylinders, electronic linear actuators, rotary actuators, or single linear or torsional springs external to the actuator 130 to rotate the ring 120. In some constructions, the one or more of the arms 210 is integrally formed in one piece with the rod 200 or mounted in another manner. In some constructions, the mounting bracket 190 is integrally formed in one piece with the hydraulic cylinder 180. In some constructions, the hydraulic cylinder 180 is double-acting instead of single-acting.

Figure 8:
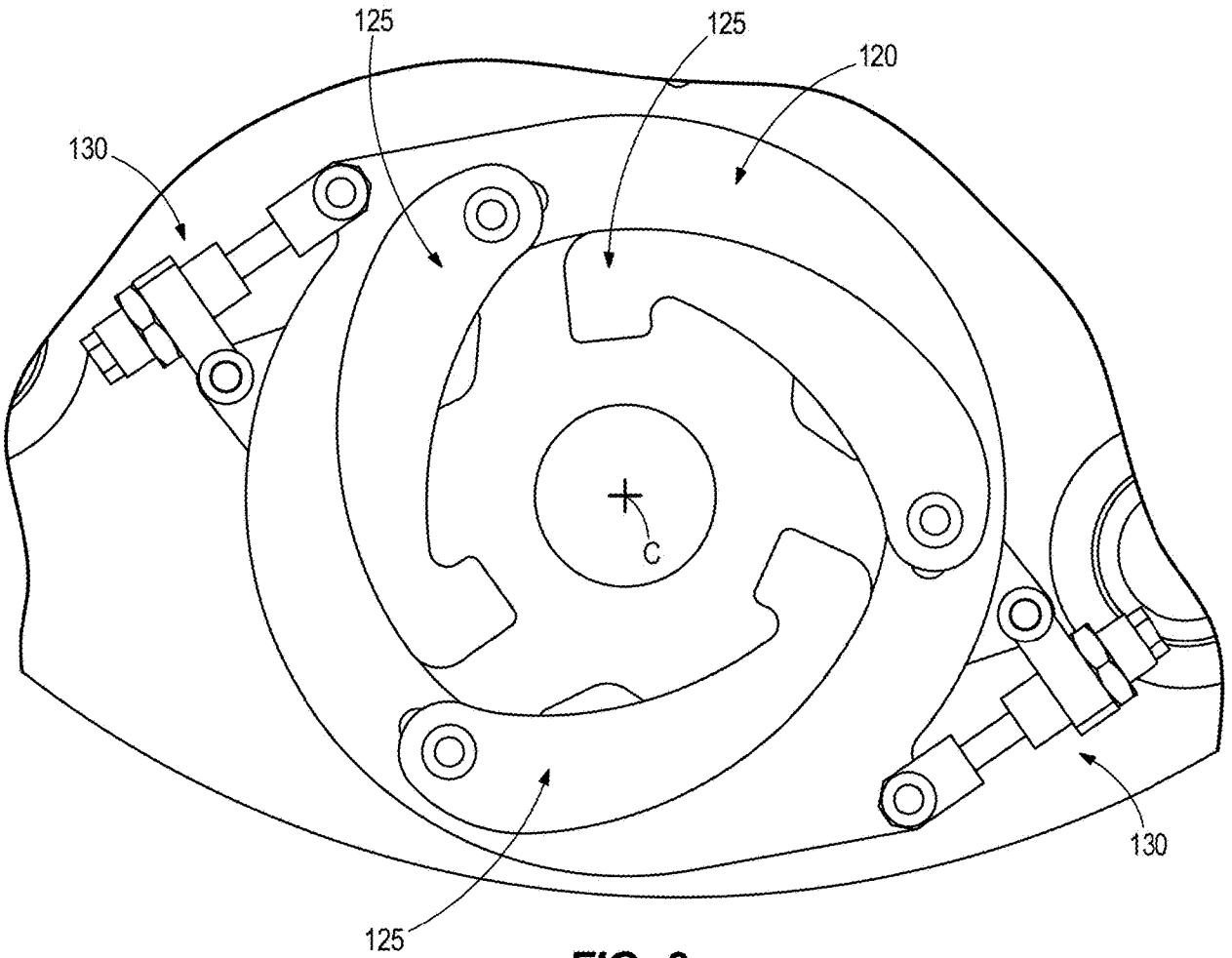
FIG. 8 is a top view of the bit positioning assembly of FIG. 3, in a first, engaged position.

FIG. 8 illustrates the drill bit retaining assembly 110 in a drill bit engagement position. When in the drill bit engagement position, the actuators 130 have caused the bit clamp members 125 to rotate simultaneously toward a centerline C of the drill bit retaining assembly 110 toward first positions. In the illustrated construction, the actuators 130 are energized and in extended positions when the bit clamp members 125 are in the first positions. In other constructions, the actuators 130 are de-energized and in retracted positions when the bit clamp members 125 are in the first positions.

Figure 9:
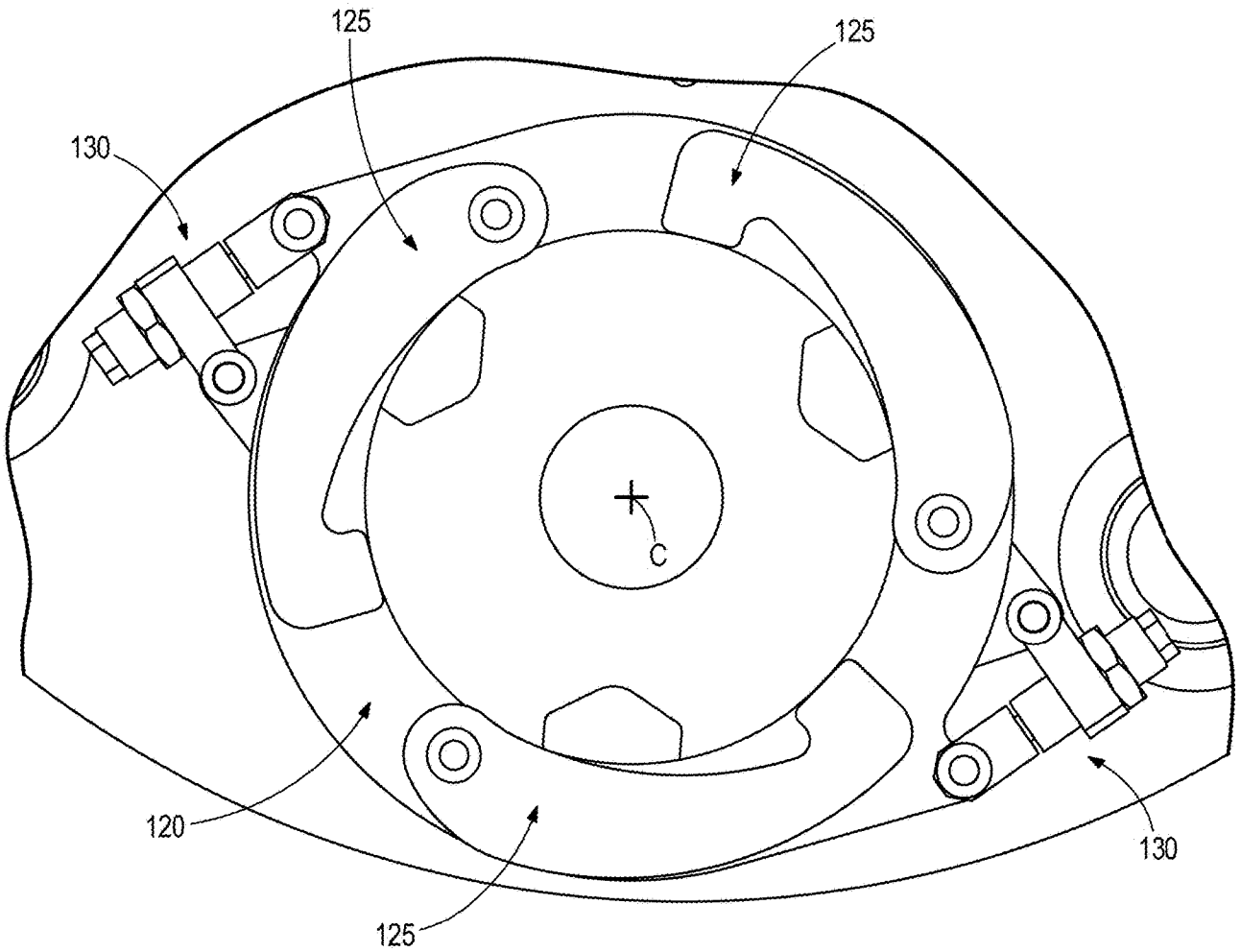
FIG. 9 is a top view of the bit positioning assembly of FIG. 3, in a second, disengaged position.

FIG. 9 illustrates the drill bit retaining assembly 110 in a drill bit disengagement position. In the illustrated construction, and with reference as well to FIG. 4, the bit clamp members 125 are positioned between the inner diameter A and the outer diameter B of the ring 120, in second positions. In the illustrated construction in FIG. 9, the actuators 130 are in retracted positions. In other constructions, the actuators 130 are in extended positions when the bit clamp members 125 are in the second positions.

Figure 10:
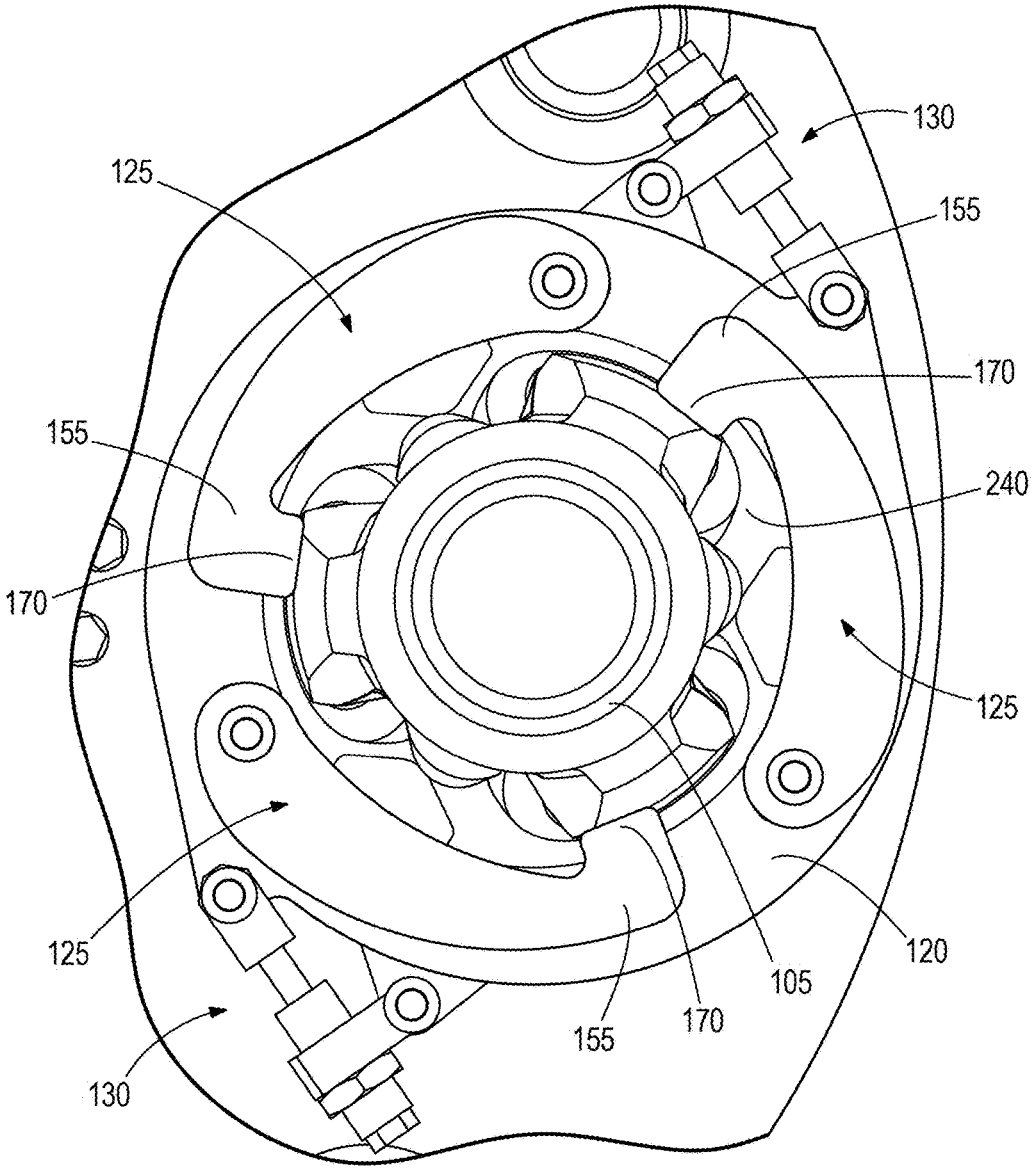
FIG. 10 is a top view of the bit positioning assembly of FIG. 3, engaged to a drill bit.

FIGS. 10 and 11 illustrate the drill bit retaining assembly 110 engaged with the drill bit 105. The drill bit 105 is disposed within an inner chamber 240 defined by the side wall 118 of the bit carousel. The ends 155 and protrusions 170 of the drill bit clamp members 125 are rotate radially inward by the actuators 130. The inward rotation of the ends 155 and the protrusions 170 toward the centerline is guided by the motion of the dowels 165 along the dowel positioning slots 140, the dowel positioning slots 140 each being elongated in a direction that is oblique to a radial direction from the centerline C. The drill bit engaging protrusions 170 of the drill bit clamp members 125 engage onto the sides of the drill bit 105 to hold and grasp onto the drill bit 105, guide the drill bit 105 into a centered position, and hold the drill bit 105 in place within the drill bit retaining assembly 110.

Figure 12:
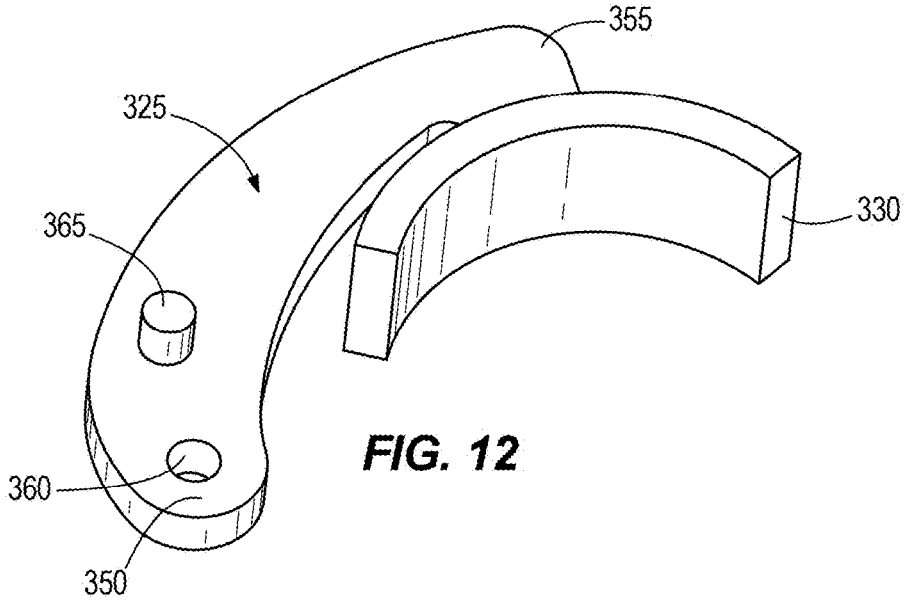
FIG. 12 is a perspective view of a bit clamp member according to another construction.
Figure 13:
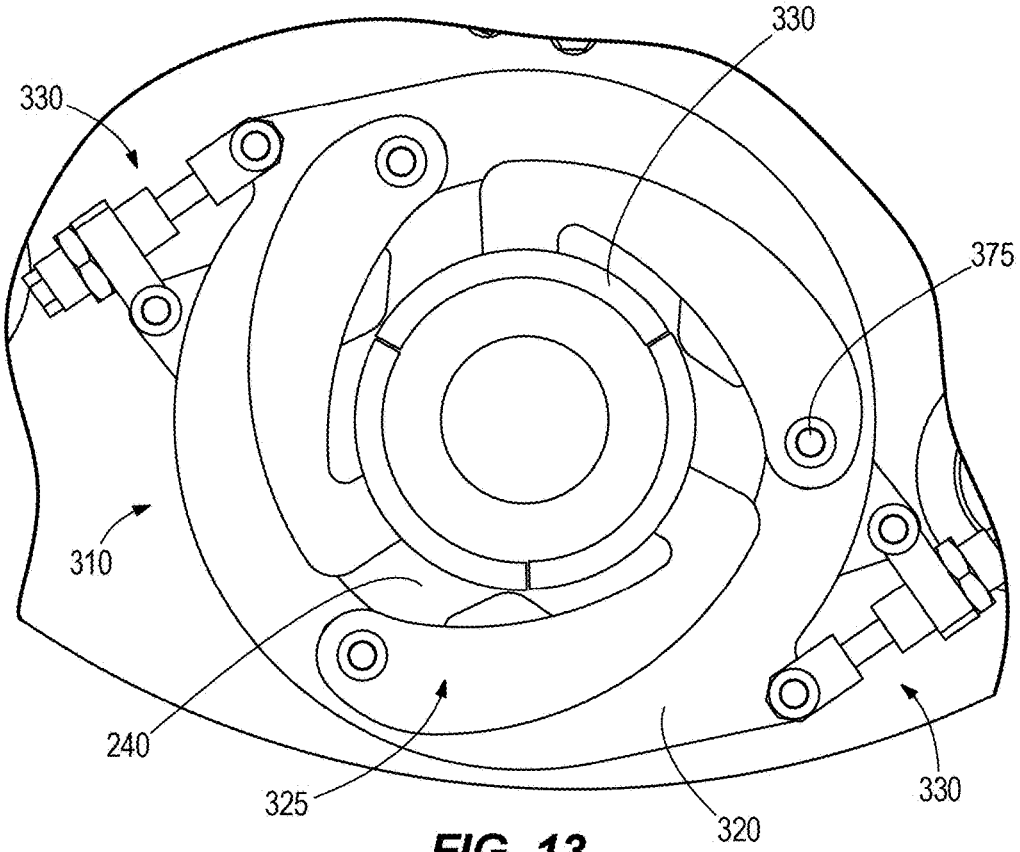
FIG. 13 is a top view of a bit positioning assembly according to another construction, using the bit clamp member of FIG. 12.

FIGS. 12 and 13 illustrate a drill bit retaining assembly 310 having a drill bit clamp member 325. The drill bit clamp member 325 includes a first end 350 and a second end 355 opposite the first end 350. An aperture 360 and a dowel 365 are positioned at the first end 350. The drill bit retaining assembly 310 also includes an actuator 330, and a pin 375, similar to the drill bit retaining assembly 110 described above. In the illustrated construction, however, the drill bit clamp member 325 includes an engaging protrusion 330 having a 120 degree arc. The engaging protrusion 330 provides an increased gripping area to grasp the drill bit 105 and in some constructions, fully protects features on the drill bit 105 (e.g., threads on the drill bit 105). FIG. 13 illustrates the drill bit retaining assembly 310 including the drill bit clamp members 325 in the drill bit engagement position. When in the drill bit engagement position, the bit engaging protrusions 330 of the three drill bit clamp members 325 are adjacent each other, forming 360 degrees of coverage around a perimeter of the drill bit 105 (not shown). This greater coverage prevents debris from falling into the inner chamber 240 and protects the threads of the drill bit 105 from damage. This construction is not limited to three drill bit clamp members 325 in the shape of 120 degree arcs. Other constructions could use more or less than three drill bit clamp members 325 with the arc length sized to provide 360 degrees of coverage around the perimeter of the drill bit 105 (not shown). Other constructions include different ranges of arc length, including bit engaging protrusions 330 that are less than 120 degrees (e.g., 90 degrees, etc.), and shapes that are not semicircular.

Figure 14:
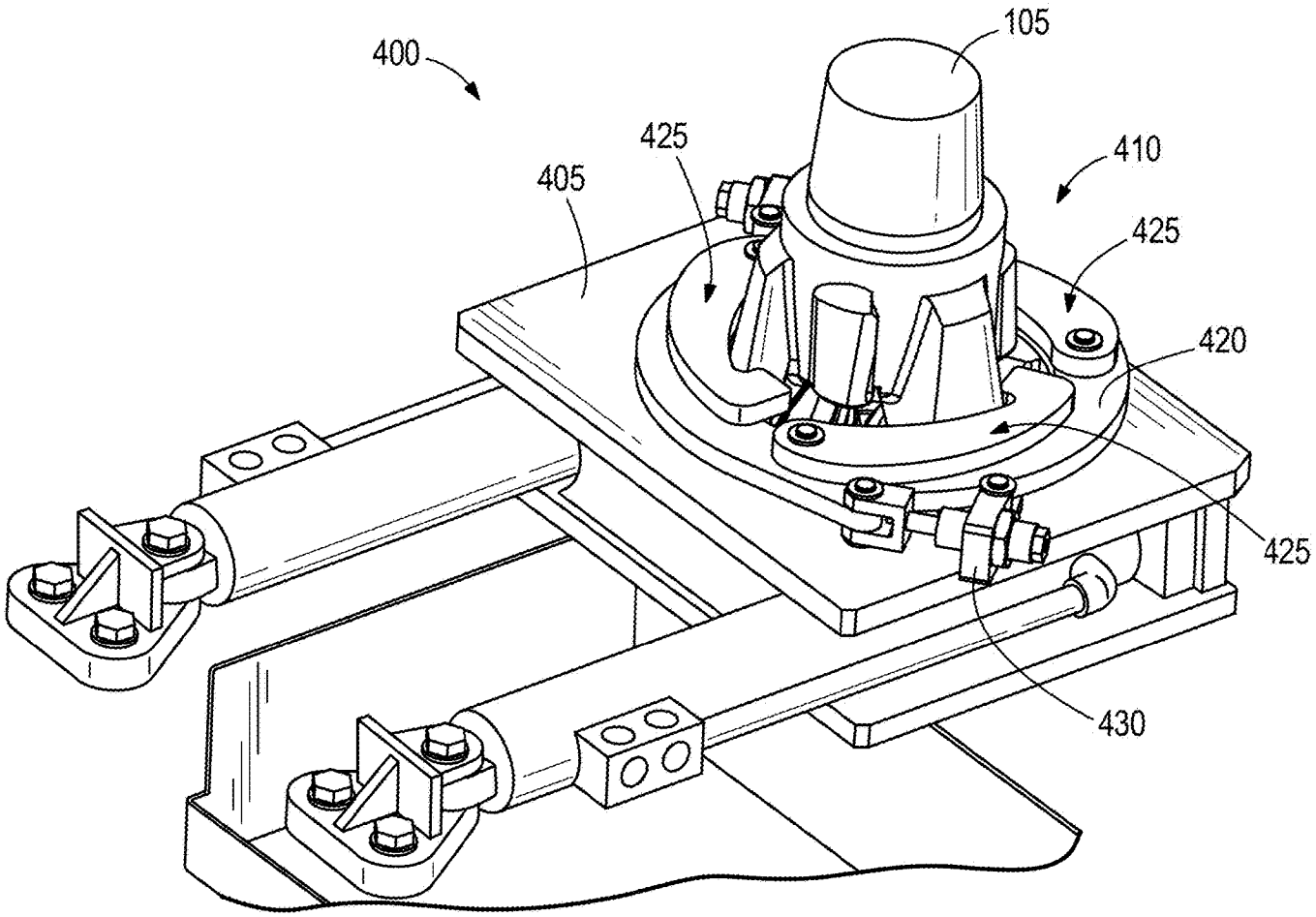
FIG. 14 is a perspective view of a drill bit changing system according to another construction.

FIG. 14 illustrates a drill bit changing system 400 that includes a bit basket 405 that moves the drill bit 105 between for example a bit carousel plate (e.g., the carousel plate 115 described above and illustrated in FIG. 2) and a drill pipe or pipes (e.g., the drill pipe 38 described above and illustrated in FIG. 1). The drill bit changing system 400 includes a drill bit retaining assembly 410 on the bit basket 405. Similar to the drill bit retaining assemblies 110, 310, the drill bit retaining assembly 410 includes a ring 420, bit clamp members 425, and at least one actuator 430 (having cylinders and rods identical to cylinders 180 and rods 200 described above) that function and move relative to one another in the same manner as that described above for the drill bit retaining assemblies 110, 310 to retain the drill bit 105.

To operate the drill bit retaining assembly 110 (and similarly to operate the drill bit retaining assembly 310 or 410), a drill bit 105 is inserted into the drill bit retaining assembly 110 while the drill bit retaining assembly 110 is in the disengagement position. The cylinders 180 are then pressurized, causing the rods 200 to extend. As the rods 200 extend, the ring 120 will rotate in a direction shown by an arrow X in FIG. 3 (in some constructions, approximately less than 10 degrees), with the pins 175 sliding along the guide slots 135 in the ring 120. As the ring 120 rotates, the drill bit clamp members 125 rotate simultaneously toward the centerline C of the drill bit retaining assembly 110, creating a clamping motion that holds the drill bit 105 and also causes the drill bit 105 to align with the centerline C of the drill bit retaining assembly 110. The three bit clamp members 125 all move at the same time, causing the drill bit 105 to be centered in the inner chamber 240. The movement of the drill bit clamp members 125 is guided by movement of the dowels 165 along the dowel positioning slots 140 in the ring 120.

When releasing the drill bit 105, pressure is removed from the cylinder 180, allowing the spring return within the cylinder 180 to retract the rod 200. As the rod 200 retracts, the ring 120 rotates in a direction shown by an arrow Y in FIG. 3, with the pins 175 again sliding along the guide slots 135. The rotation of the ring 120, which is guided by the pins 175 sliding along the guide slots 135, causes the second ends 155 and the engaging protrusions 170 of the drill bit clamp members 125 to move away from the centerline C, eventually aligning over the ring 120 in a space bordered by the inner ring diameter A and the outer ring diameter B (FIG. 9). The motion of the drill bit clamp members 125 is guided by movement of the dowel 165 along the dowel positioning slots 140 in the ring 120.

Figure 15:
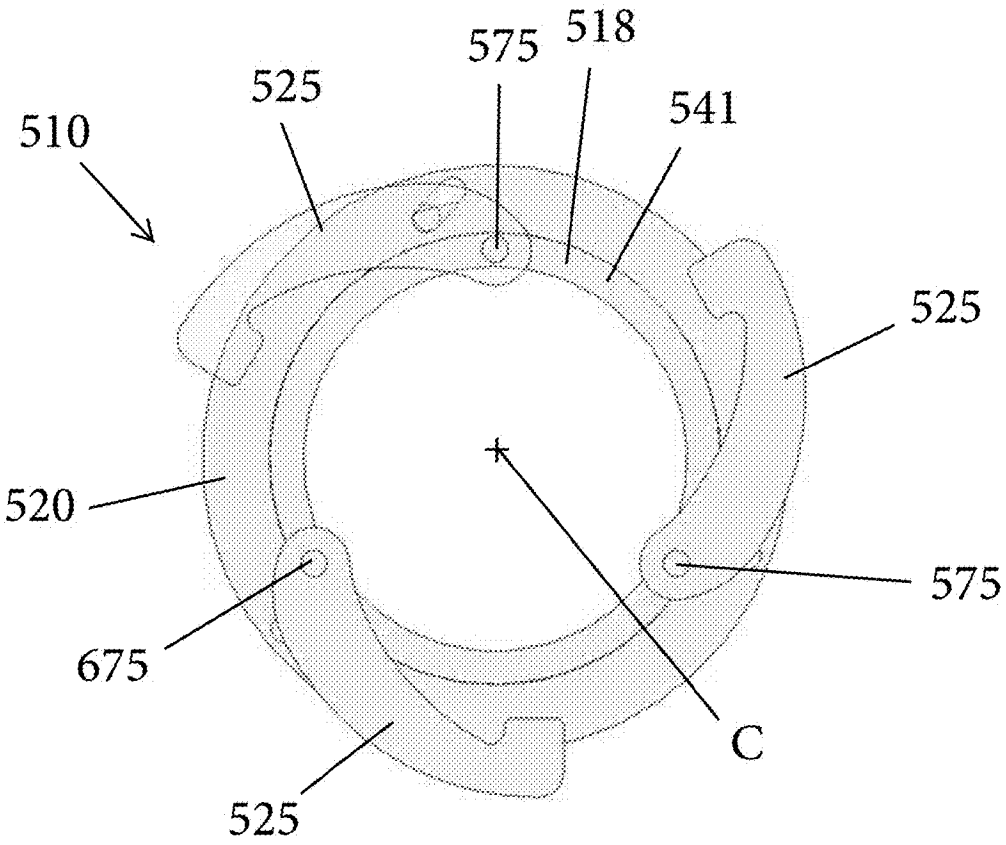
FIG. 15 is a perspective view of a drill bit retaining assembly according to another construction.

In some constructions, the actuator 130 is in its depressurized (e.g. de-energized) position when in the drill bit engagement position, and the actuator 130 is in the pressurized (energized) position when the in the drill bit disengagement position. In some constructions, the drill bit retaining assembly 110 does not utilize the pins 175 for guidance and movement. In some constructions, as illustrated in FIG. 15, a drill bit retaining assembly 510 includes a groove 541 machined out along the top of a side wall 518 to guide pins 575 (which in this construction are disposed radially inwardly of the ring 520) and force a ring 520 and bit clamp members 525 to rotate about the axis C. In other constructions, or one or more other structures or features (e.g., groove, protrusion, etc.) are provided, that force a ring of one of the drill bit retaining assemblies described herein to rotate about the axis C.

Although the invention has been described in detail with reference to certain preferred constructions, variations and modifications exist within the scope and spirit of one or more independent aspects of the invention as described.

What is claimed is:

1. A drill bit retaining assembly comprising:

a ring;

a bit clamp member coupled to the ring; and an actuator coupled to the ring;

wherein activation of the actuator is configured to generate both rotation of the ring and rotation of the bit clamp member relative to the ring, wherein the bit clamp member is movable via the actuator between a first position, in which the bit clamp member is configured to engage with a drill bit and a second position in which the bit clamp member is configured to be disengaged from the drill bit.

2. The drill bit retaining assembly of claim 1, wherein the bit clamp member includes a first end that is engaged with the ring and a second, opposite end, wherein the second end includes a protrusion that is configured to engage with the drill bit.

3. The drill bit retaining assembly of claim 2, wherein the protrusion has a shape that corresponds to a feature on the drill bit.

4. The drill bit retaining assembly of claim 1, wherein the bit clamp member is a first bit clamp member, and wherein the drill bit retaining assembly includes a second bit clamp member coupled to the ring, and a third bit clamp member coupled to the ring.

5. The drill bit retaining assembly of claim 4, wherein each of the first bit clamp member, the second bit clamp member, and the third bit clamp member includes a first end that is engaged with the ring and a second, opposite end, wherein the second end of each of the first bit clamp member, the second bit clamp member, and the third bit clamp member includes a protrusion that is configured to engage with the drill bit.

6. The drill bit retaining assembly of claim 5, wherein each of the protrusions of the first bit clamp member, the second bit clamp member, and the third bit clamp member extends 120 degrees.

7. The drill bit retaining assembly of claim 1, wherein the bit clamp member is in the first position when the actuator is energized, and wherein the bit clamp member is in the second position when the actuator is not energized.

8. The drill bit retaining assembly of claim 1, wherein the ring includes a guide slot, and wherein the drill bit retaining assembly includes a pin that extends into the guide slot, such that the ring may rotate when the pin slides within the guide slot.

9. The drill bit retaining assembly of claim 8, wherein the ring further includes a dowel positioning slot, and wherein the bit clamp member includes a dowel that extends into the dowel positioning slot, such that the bit clamp member may rotate relative to the ring when the dowel slides within the dowel positioning slot.

10. The drill bit retaining assembly of claim 1, wherein the ring includes a dowel positioning slot, and wherein the bit clamp member includes a dowel that extends into the dowel positioning slot, such that the bit clamp member may rotate relative to the ring when the dowel slides within the dowel positioning slot.

11. The drill bit retaining assembly of claim 10, wherein the ring extends about a centerline, and wherein the dowel positioning slot extends at an oblique angle relative to a radial direction from to the centerline.

12. The drill bit retaining assembly of claim 1, wherein the ring includes a mounting aperture, and wherein a pin extends through the mounting aperture to couple the ring to the actuator.

13. The drill bit retaining assembly of claim 1, wherein the actuator is a linear actuator.

14. The drill bit retaining assembly of claim 13, wherein the linear actuator includes a hydraulic cylinder, a clevis, a mounting bracket, and a jam nut.

15. The drill bit retaining assembly of claim 14, wherein the cylinder is a single-acting cylinder having a rod, wherein the rod includes a threaded aperture, wherein the rod is coupled to the clevis, wherein the clevis includes arms that are substantially parallel, wherein each arm includes an aperture that is aligned with a mounting aperture on the ring, and wherein a screw is threadedly engaged with the threaded aperture in the rod.

16. The drill bit retaining assembly of claim 1, wherein the ring has an outer diameter and an inner diameter.

17. A drill rig comprising:

a base;

a drill tower extending from the base;

a drill pipe coupled to and extending from the drill tower; and a drill bit changing system including a carousel, and the bit retaining assembly of claim 1 coupled to the carousel.

18. A drill rig comprising:

a base;

a drill tower extending from the base;

a drill pipe coupled to and extending from the drill tower; and a drill bit changing system including a bit basket, and the bit retaining assembly of claim 1 coupled to the bit basket.

19. A drill bit retaining assembly comprising:

a ring having a guide slot;

a side wall having a pin that extends into the guide slot, such that the ring may rotate in a motion prescribed by the pin sliding within the guide slot;

a bit clamp member coupled to the ring, wherein the bit clamp member includes a first end that is engaged with the ring and a second, opposite end, wherein the second end includes a protrusion that is configured to engage with the drill bit; and an actuator coupled to the ring;

wherein activation of the actuator is configured to generate both rotation of the ring and rotation of the bit clamp member relative to the ring, wherein the bit clamp member is movable via the actuator between a first position, in which the bit clamp member is configured to engage with a drill bit and a second position in which the bit clamp member is configured to be disengaged from the drill bit.

20. The drill bit retaining assembly of claim 19, wherein the actuator is a linear actuator.

21. The drill bit retaining assembly of claim 19, wherein the ring includes a dowel positioning slot, and wherein the bit clamp member includes a dowel that extends into the dowel positioning slot, such that the bit clamp member may rotate relative to the ring when the dowel slides within the dowel positioning slot.

* * * * *